US008137055B2

(12) United States Patent
Lang

(10) Patent No.: US 8,137,055 B2
(45) Date of Patent: Mar. 20, 2012

(54) TURBINE BLADE WITH AN IMPINGEMENT COOLING INSERT

(75) Inventor: Gernot Lang, Baesweiler (DE)

(73) Assignee: Siemens Aktiengesellschaft, Munich (DE)

( * ) Notice: Subject to any disclaimer, the term of this patent is extended or adjusted under 35 U.S.C. 154(b) by 1219 days.

(21) Appl. No.: 11/578,920

(22) PCT Filed: Apr. 1, 2005

(86) PCT No.: PCT/EP2005/051487

§ 371 (c)(1),
(2), (4) Date: Sep. 17, 2007

(87) PCT Pub. No.: WO2005/103452

PCT Pub. Date: Nov. 3, 2005

(65) Prior Publication Data

US 2008/0260537 A1 Oct. 23, 2008

(30) Foreign Application Priority Data

Apr. 20, 2004 (EP) ..... 04009326

(51) Int. Cl.
*F01D 5/18* (2006.01)

(52) U.S. Cl. ..... 415/115; 415/134; 416/96 A

(58) Field of Classification Search ..... 415/115, 415/134, 136; 416/96 R, 96 A, 97 R
See application file for complete search history.

(56) References Cited

U.S. PATENT DOCUMENTS

| | | | | |
|---|---|---|---|---|
| 2,847,185 | A * | 8/1958 | Petrie et al. | 415/115 |
| 2,873,944 | A * | 2/1959 | Wiese et al. | 416/92 |
| 2,888,241 | A | 5/1959 | Stalker | |
| 3,707,750 | A | 1/1973 | Klass | |
| 4,056,332 | A | 11/1977 | Meloni | |
| 4,257,734 | A * | 3/1981 | Guy et al. | 415/115 |
| 4,403,917 | A | 9/1983 | Laffitte et al. | |
| 6,439,847 | B2 | 8/2002 | Taeck | |
| 7,056,083 | B2 * | 6/2006 | Gray | 415/115 |
| 7,104,756 | B2 * | 9/2006 | Harding et al. | 416/96 A |

FOREIGN PATENT DOCUMENTS

| | | |
|---|---|---|
| GB | 833770 | 4/1960 |
| GB | 1 261 765 | 1/1972 |
| GB | 2 386 926 A | 10/2003 |
| JP | 2001140602 A | 5/2001 |

* cited by examiner

*Primary Examiner* — Nathaniel Wiehe

(57) ABSTRACT

A turbine blade, particularly a guide blade for a gas turbine, is provided. The turbine blade includes a blade leg, a platform area and a hollow blade for receiving a metal plate-type impact cooling insert which consists of at least two sections which overlap in an overlap area. The two sections have a wave-shaped cross-section in the overlap area in order to seal said overlap area.

15 Claims, 2 Drawing Sheets

TURBINE BLADE WITH AN IMPINGEMENT COOLING INSERT

CROSS REFERENCE TO RELATED APPLICATIONS

This application is the US National Stage of International Application No. PCT/EP2005/051487, filed Apr. 1, 2005 and claims the benefits of European Patent application No. 04009326.2 filed Apr. 20, 2004. All of the applications are incorporated by reference herein in their entirety.

FIELD OF THE INVENTION

The invention relates to a cooled turbine blade, which comprises, in series, a blade root, a platform section and a hollow blade airfoil for the accommodation of a sheet metal-form impingement cooling insert which has at least two sections lying one upon the other, overlapping in an overlap area, which form a gap with a gap opening. In addition, the invention relates to a gas turbine as claimed in the claims.

BACKGROUND OF THE INVENTION

A cooled gas turbine blade with sheet metal-form impingement cooling inserts is known from JP 2001-14 06 02-A. An impingement cooling insert, triangular-shaped in cross section, installed in the region of the blade trailing edge of the turbine blade, is spaced away from the inner surface of the outer wall and provided with impingement cooling holes. During the operation of the gas turbine, the cavity enclosed by the impingement cooling insert is fed with cooling air, which then exits through the impingement cooling holes and impinges upon the inner surface of the externally hotly flow-washed outer wall, in order to cool the latter.

Moreover, U.S. Pat. No. 6,439,847 discloses a turbine blade with an insert of a form-memory alloy which for the improvement of the cooling of the turbine blade increases the volume of a cooling system by contraction after the exceeding of a threshold temperature. The insert, changing in its cross-sectional shape, has two overlapping sheet metal ends, which are displaceable parallel to the flow direction of a hot gas. In an alternative development, U.S. Pat. No. 6,439,847 shows, moreover, a wave-like insert of a form-memory alloy.

In addition, it is known that impingement cooling inserts comprise two separate parts which are inserted one after the other into the cavity of a turbine blade. The first part is fixed gastight on the radially inner platform and the second part is fixed gastight on the radially outer platform in order to avoid losses in the feed region. As a result, the two parts lie one upon the other in an overlapping flat sliding seat to enable a relative movement during the operation of the gas turbine.

During cold start or during transient operation of the gas turbine, different thermal expansions take place in the gas turbine blade, especially in the hotly flow-washed outer wall and in the cooler impingement cooling insert which is not yet completely heated or unevenly heated. These, especially expansions occurring in the direction of the blade axis, can mechanically relieve the overlap area or the sliding seat respectively and so enable an unwanted gap between the two abutting sections of the impingement cooling element through which cooling air can escape from the inside of the impingement cooling insert, unused as leakage.

SUMMARY OF THE INVENTION

The object of the invention is, therefore, the specification of a turbine blade which saves cooling medium. In addition, it is an object of the invention to specify a correspondingly improved gas turbine for this.

The problem focused on the turbine blade is solved by the features of the claims, and the problem focused on the gas turbine is solved by the features of the claims. Advantageous developments are specified in the dependent claims.

The solution of the problem focused on the turbine blade proposes that for the sealing of the overlap area the two sections are formed wave-like in cross section and, with regard to the gap opening, formed parallel to this.

The solution is based therein on the knowledge, that by the wave-like overlapping of the two sections the overlap area formed between them is enlarged and a contact region is purposefully created, upon which the two sections lie one upon the other, sealing the gap encompassed by them.

The waveform has then an ascending flank between a wave trough and a wave crest, and a descending flank between a wave crest and a wave trough. The waveform of the two overlapping sections formed by the wave troughs and by the wave crests extend approximately parallel, so that contact surfaces are formed in each case between adjacent ascending flanks and/or between adjacent descending flanks, which prevent the leakage flow. This leads to an economy of cooling medium. Furthermore, the use of such a turbine blade in a gas turbine leads to an efficiency increase during operation.

Additionally, a mechanical movability of the two tightly abutting sections is provided which are necessary for the compensation of the thermal material expansion during cold start or during transient operation of the gas turbine as the case may be.

According to an advantageous development, the frequency and/or the amplitude of the waveform of the first element deviates from the second frequency or amplitude respectively of the waveform of the second element. By this, the waveform of the two sections in the overlap area are reliably prevented from forming a meander-shape gap extending parallel to it, i.e. in the direction of the leakage flow. Consequently, a contact surface lying between two ascending or descending flanks is necessarily formed, which despite the different thermal material expansions or a displacement in relation to one another on account of the sealing force effective in the contact surface, ensures an especially tight overlap area.

The overlap areas can thus be securely sealed, especially during the starting of the gas turbine, with an already hot turbine blade outer wall and still comparatively cool impingement cooling insert.

The development in which the frequency (and/or amplitude) of the waveform of the first element differs from the frequency (and/or amplitude) of the waveform of the second element in an order of magnitude of max. ±6%, is especially advantageous. The frequencies and the amplitudes, therefore, are selected so that the heat-conditioned material expansions of the elements cause no mutual mechanical impediment and so ensure a reliable sealing action. Furthermore, the parameters of the waveform are matched to the material of the impingement cooling insert.

The construction space required for the overlap area can be especially space-saving if the overlap area has no more than five oscillation periods in cross section.

According to an especially advantageous development, the impingement cooling insert is formed multi-part. Therefore, the parts forming the impingement cooling insert can be inserted successively from a blade tip, which is open at the top, into the hollow blade airfoil. After that, the sections of the individual parts lie one upon the other in each case in an overlap area which is also designated as a sliding seat. An especially simple displacement is ensured, as the displacement direction of the impingement cooling insert extends perpendicularly to the extent of the wave.

BRIEF DESCRIPTION OF THE DRAWINGS

The invention is explained in greater detail with reference to drawings.

Therefore, in the drawings.

DETAILED DESCRIPTION OF THE INVENTION

Figure 1:
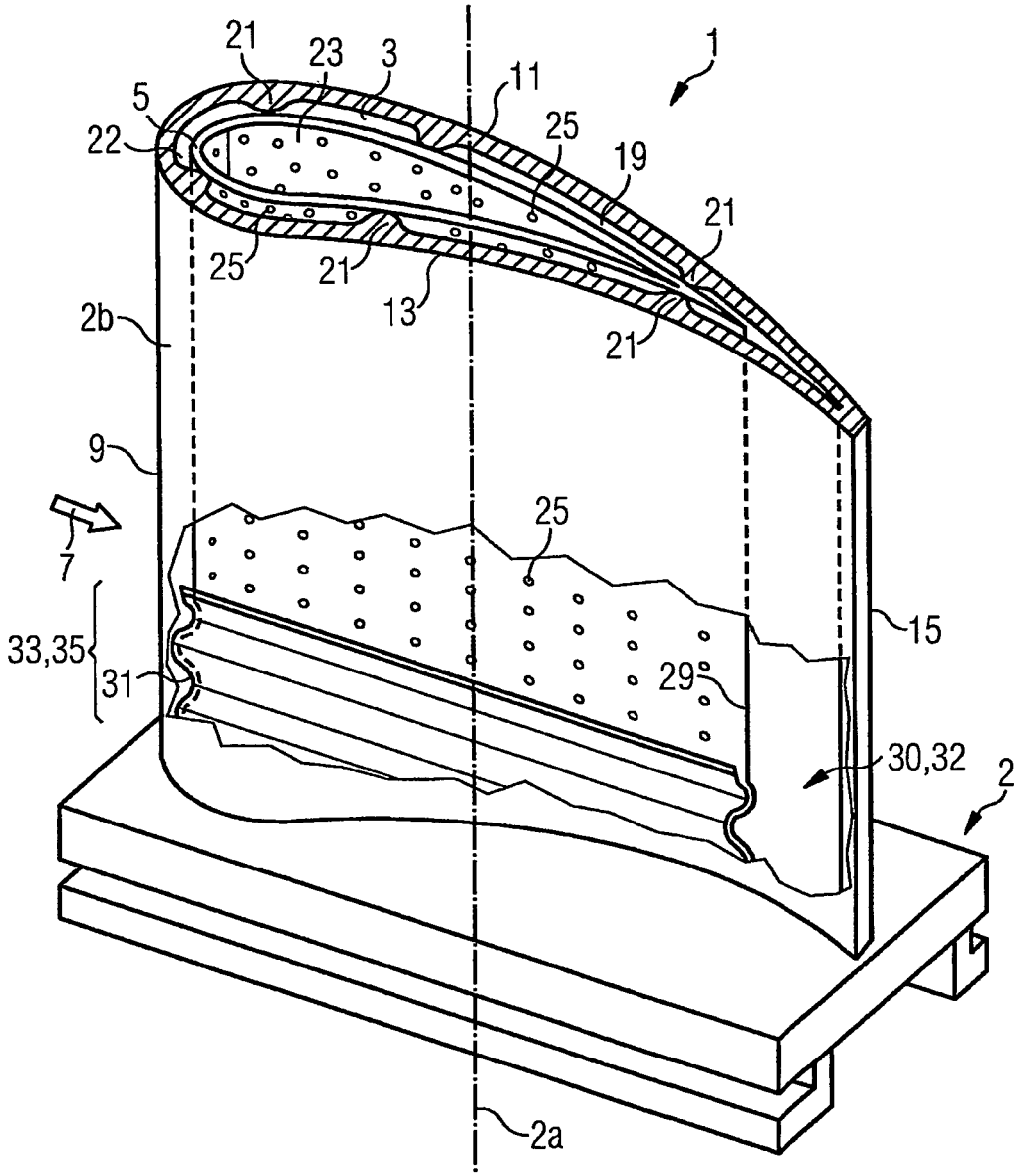
FIG. 1 shows a perspective view of a turbine blade with an impingement cooling insert.

Gas turbines and their principles of operation are generally known. FIG. 1 shows a perspective view of a turbine blade 1 according to the invention with a platform section 2 and with a blade airfoil 2*b* extending along a blade axis 2*a*. The blade airfoil 2*b* has at least one cavity 3, in which an impingement cooling insert 5 is provided. Furthermore, the blade airfoil 2*b* has a blade leading edge 9 flow-washable by a hot gas 7 of the gas turbine, from which extends in the direction of a blade trailing edge 15 a suction-side wall 11 and a pressure-side wall 13. The turbine blade 1 can be both a stator blade and also a rotor blade. The inner surfaces 19 of the side walls 11,13 encompass the cavity 3. The surface 19 is spaced away from the impingement cooling insert 5 by means of a plurality of rib-form or circular spacing elements 21, forming an interspace 22. The cooling medium passage 23 enclosed inside the impingement cooling insert 5 is flow-washable by a cooling medium. The impingement cooling inserts 5 additionally have impingement cooling holes 25, through which flows cooling medium flowing in the cooling medium passage 23, and can subsequently impinge perpendicularly upon the surfaces 19 of the side walls 11,13, in order to cool these.

The impingement cooling insert 5, viewed in the direction of the blade axis 2*a*, is formed consequently from two separate parts 29,31, which, by a section 30,32 in each case, overlap each other in an overlap area 33,35. The overlap area 33,35 lies as a consequence outside the mean blade airfoil height.

The bottom part 31 of the impingement cooling insert, shown in FIG. 1, is fixed in the connecting area gastight on the lower platform, and the top part 29 is fixed gastight on an upper platform, which is not shown, for the avoidance of leakages.

As the hot blade airfoil 2*b* expands more in the direction of the blade axis 2*a* than the cool impingement cooling insert 5 during the operation of the gas turbine, a movability of the two fixed parts 29,31, directed along the blade axis 2*a*, is necessary in the overlap area 33, 35.

Figure 2:
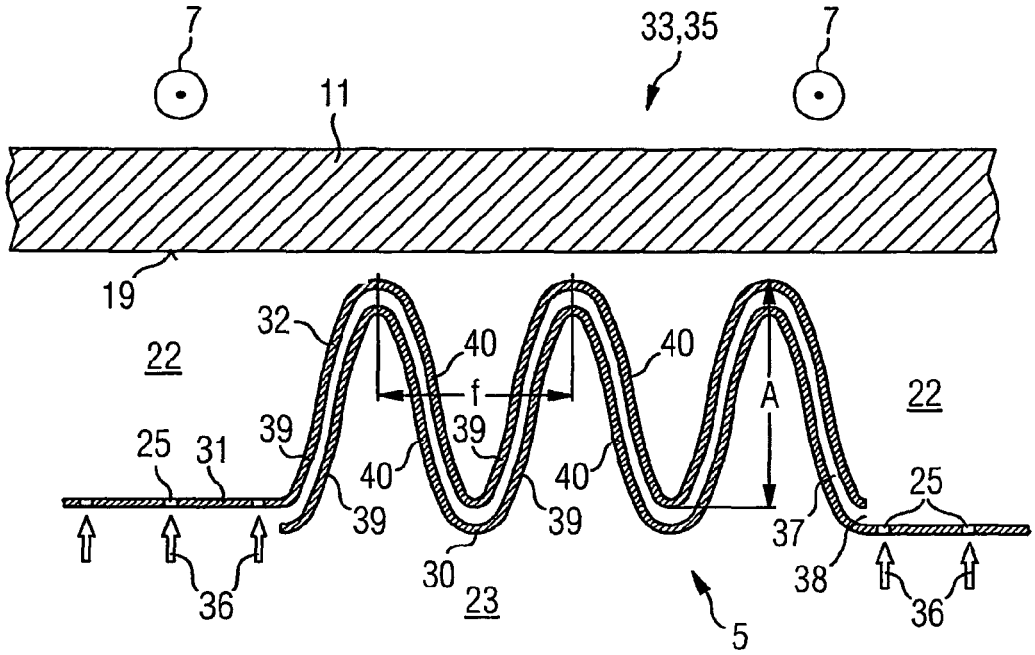
FIG. 2 shows the detailed view of an overlap area of the impingement cooling insert of the turbine blade according to FIG. 1.
Figure 3:
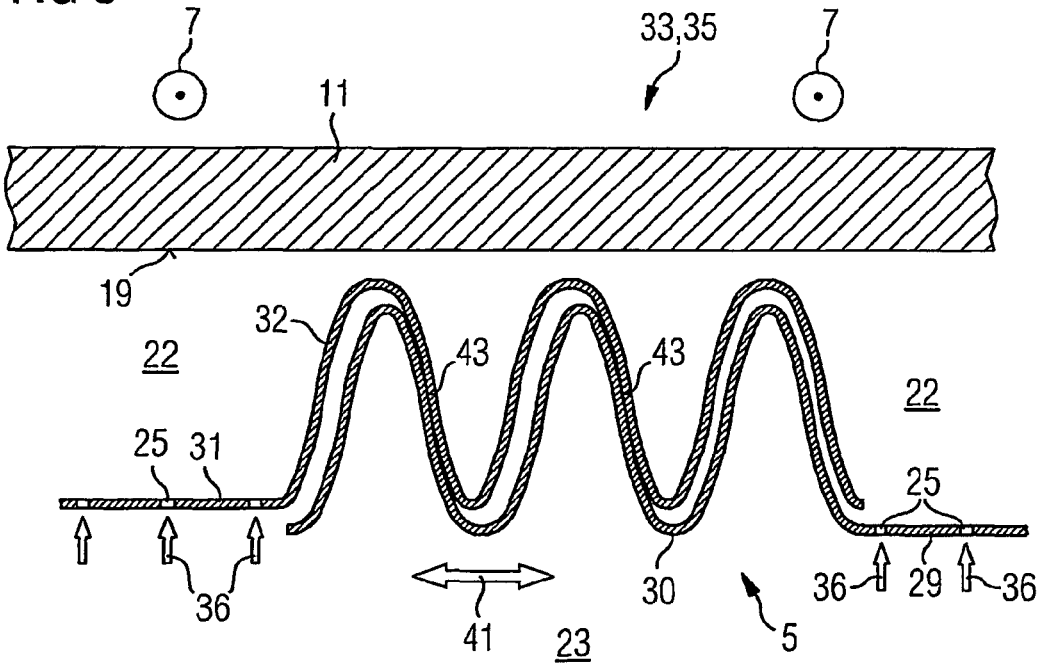
FIG. 3 shows the detailed view of an alternative overlap area of the impingement cooling insert of the turbine blade according to FIG. 1

FIG. 2 and FIG. 3 show respectively an alternative development of the overlap area 33,35 in a detailed view.

The impingement cooling insert 5 is spaced away from the inner surface 19, forming an interspace 22. During the operation of the gas turbine the suction-side wall 11 is flow-washed by the hot gas 7. For the cooling of the suction-side wall 11, cooling medium 36 flows from the cooling medium passage 23 through the impingement cooling holes 25 and impinges on the inner surface 19, cooling it.

In FIG. 2, the two sections 30,32 are formed with an identical waveform, i.e. the waveforms of the two sections 30,32 of the parts 29,31 have an identical frequency f and an identical amplitude A. By means of the waveform, a meander-form gap 37, with a gap opening 38 which is rectilinear and parallel to the wave extension, i.e. to the wave front, is formed between the two sections 30,32, from out of which flows a leakage reduced by vorticities compared with a leakage in a flat overlap area according to the prior art. With a displaced position of the sections 30,32 to the left or right in relation to each other with regard to FIG. 2, and consequently along the blade axis 2*a*, the ascending flanks 39 or the descending flanks 40 of the adjacent sections 30,32 can, however, lie tightly one upon the other, forming a contact surface. A displacement of the two parts 29,31 perpendicularly to it is not possible on account of the predetermined geometry of the blade airfoil 2*b* and of the impingement cooling insert 5.

FIG. 3 shows the overlap area 33 with the two oppositely disposed sections 30,32 which have a different frequency f and a different amplitude A. By this, a clearance between the two sections 30,32 in the direction of the arrow 41, therefore parallel to the blade axis 2*a*, is possible, without which the sealing action of the overlap area 33 reduces. Regardless of the thermal expansions of the impingement cooling insert 5, the ascending flanks 39 or descending flanks 40, as the case may be, of the waveform of at least one period of the two sections 30,32 lie sealed one upon the other so that at any time a contact surface 43 extending parallel to the blade axis 2*a* and to the gap face 38 exists.

With the occurrence of material expansions or displacements respectively of the sections 30,32 in relation to one another, the contact surface 43 shifts inside the overlap area 33,35 from one period to an adjacent period. Therefore, a minimum number of two periods are advisably provided in the overlap area 33,35 in order to achieve an especially reliable sealing of the cooling medium passage 23 in relation to the interspace 22.

According to requirement, impingement cooling holes 25 can also be provided in the overlap area 33,35, especially in the region of the wave troughs or wave crests of the sections 30,32, for the more even cooling of the side walls 11,13.

The waveform is not necessarily sinusoidal. The same effect is achievable even with a waveform comprising semicircles or semi-ellipses in series. Furthermore, a triangular shape, a saw tooth shape, or a rectangular shape is also conceivable.

A cooling air economy can be achieved by the improved sealing action of the impingement cooling insert 5 in comparison to the flat contact surfaces from the prior art, which leads to an efficiency increase during the use of the turbine blade in a gas turbine. Also, the wave-form overlapping according to the invention is transferable to each impingement-cooled component of a gas turbine with an impingement cooling baffle plate, for example, to a guide ring lying on the outside opposite the rotor blade or to a combustion chamber heat shield.

The invention claimed is:

1. A turbine stator blade for a gas turbine, comprising:

a blade root;

a platform section arranged on the blade root;

a hollow blade airfoil arranged on the platform section having an interior wall surface that defines an interior portion of the hollow blade airfoil;

a sheet metal-form impingement cooling insert arranged in the hollow blade airfoil that separates the interior cavity to form an interspace portion and a cooling medium passage, the interspace portion defined as a rectilinearly extending gap between the interior wall surface and the cooling insert; and a plurality of cooling impingement holes arranged in the impingement cooling insert, wherein a cooling medium flows from the cooling medium passage into the interspace portion, wherein the cooling insert comprises a plurality of cooling insert sections arranged one upon the other overlapping in an overlap area having a wave-like cross section and extending parallel to the rectilinear gap, wherein for sealing the overlap area the cooling insert sections are displaced in such a way that in the overlap area a contact surface is formed, the contact surface extends rectilinearly.

2. The turbine blade as claimed in claim 1, wherein the frequency or the amplitude of the wave-like cross section of a first cooling insert section is different from the frequency or amplitude of the wave-like cross section of a second cooling insert section.

3. The turbine as claimed in claim 2, wherein the frequency or amplitude of the waveform of the first cooling insert section differs from the frequency or amplitude of the waveform of the second cooling insert section in an order of magnitude of ±6%.

4. The turbine blade as claimed in claim 1, wherein the frequency and the amplitude of the wave-like cross section of a first cooling insert section is different from the frequency and amplitude of the wave-like cross section of a second cooling insert section.

5. The turbine as claimed in claim 4, wherein the frequency and amplitude of the waveform of the first cooling insert section differs from the frequency and amplitude of the waveform of the second cooling insert section in an order of magnitude of ±6%.

6. The turbine blade as claimed in claim 1, wherein the overlap area has no more than 5 oscillation periods.

7. A gas turbine, comprising:

an inlet that admits a working fluid;

a compressor section connected to the inlet that compresses the working fluid;

a combustion section that receives the compressed working fluid and combusts a fuel to produce a hot working fluid; and a turbine section that expands the hot working fluid having a of hollow turbine blade, comprising:

a blade root, a platform section arranged on the blade root, a hollow blade airfoil arranged on the platform section having an interior wall surface that defines an interior portion of the hollow blade airfoil, and a sheet metal-form impingement cooling insert arranged in the hollow blade airfoil that separates the interior cavity to form an interspace portion and a cooling medium passage, the interspace portion defined as a rectilinearly extending gap opening between the interior wall surface and the cooling insert where a cooling medium flows from the cooling medium passage into the interspace portion, the cooling insert comprises a plurality of cooling insert sections arranged one upon the other overlapping in an overlap area having a wave-like cross section and extending parallel to the rectilinear gap, wherein for sealing the overlap area the cooling insert sections are displaced in such a way that in the overlap area a contact surface is formed, the contact surface extends rectilinearly.

8. The gas turbine as claimed in claim 7, wherein the turbine section comprises a plurality of hollow turbine blades.

9. The gas turbine as claimed in claim 7, wherein the hollow turbine blades are rotating blades.

10. The gas turbine as claimed in claim 7, wherein the hollow turbine blades are stationary blades.

11. The turbine blade as claimed in claim 7, wherein the frequency or the amplitude of the wave-like cross section of a first cooling insert section is different from the frequency or amplitude of the wave-like cross section of a second cooling insert section.

12. The turbine as claimed in claim 11, wherein the frequency or amplitude of the waveform of the first cooling insert section differs from the frequency or amplitude of the waveform of the second cooling insert section in an order of magnitude of ±6%.

13. The turbine blade as claimed in claim 7, wherein the frequency and the amplitude of the wave-like cross section of a first cooling insert section is different from the frequency and amplitude of the wave-like cross section of a second cooling insert section.

14. The turbine as claimed in claim 13, wherein the frequency and amplitude of the waveform of the first cooling insert section differs from the frequency and amplitude of the waveform of the second cooling insert section in an order of magnitude of ±6%.

15. The turbine blade as claimed in claim 7, wherein the overlap area has no more than 5 oscillation periods.

* * * * *